US005374509A

United States Patent [19]

Valentini

[11] Patent Number: 5,374,509

[45] Date of Patent: Dec. 20, 1994

[54] PHOTOGRAPHIC ELEMENT CONTAINING A BINDER COMPOSITION FOR IMPROVED DRYING CHARACTERISTICS

[75] Inventor: Jose Valentini, Hendersonville, N.C.

[73] Assignee: E. I. Du Pont de Nemours and Company, Wilmington, Del.

[21] Appl. No.: 237,801

[22] Filed: May 4, 1994

[51] Int. Cl.[5] ..... G03C 1/77

[52] U.S. Cl. ..... 430/536; 430/523; 430/531; 430/539; 430/627; 430/631; 428/483; 428/525; 428/522

[58] Field of Search ..... 430/523, 531, 536, 539, 430/627, 631, 637; 428/483, 515, 522

[56] References Cited

U.S. PATENT DOCUMENTS 3,623,868 11/1971 Cronig ..... 96/48
4,710,456 12/1987 Naoi et al. ..... 430/564
5,098,948 3/1992 Kawabata ..... 524/522
5,219,718 6/1993 Hatakeyama et al. ..... 432/536

FOREIGN PATENT DOCUMENTS

3832142C2 4/1990 Germany .

*Primary Examiner*—Jack P. Brammer

[57] ABSTRACT

A photographic element is provided which readily absorbs aqueous solution during processing and yet readily liberates the water during drying. The photographic element comprises a support; at least one layer coated on said support wherein said layer comprises:

(a) hydrophilic colloid;

(b) a branched polysaccharide;

(c) a polyacrylamide; and at least one of either (d) or (e):

(d) a mixture of polyvinylidene chloride and polyacrylate; or (e) a copolymer of vinylidene chloride and acrylate.

10 Claims, No Drawings

PHOTOGRAPHIC ELEMENT CONTAINING A BINDER COMPOSITION FOR IMPROVED DRYING CHARACTERISTICS

FIELD OF INVENTION

This invention is related to a photographic composition with improved drying characteristics. More specifically, this invention relates to a photographic binder composition with a specific combination of ingredients which allows for an increased rate of drying during manufacture and photographic processing.

BACKGROUND OF THE INVENTION

Advances in the art of photographic elements have led to a decrease in the amount of time allowed for processing to develop the image. For example, in medical X-ray films the total processing time has decreased from over 3 minutes to less than 60 seconds over the past few decades. Medical X-ray processing typically involves the sequential steps of development, fix, wash and dry. During development a latent image in the image wise exposed regions of a film is converted to elemental silver. During the fixing step the silver halide from the unexposed regions of the film is removed leaving a negative reproduction of the original image. The film is then subjected to washing to remove deleterious materials and finally the film is dried yielding a negative reproduction of the original image.

As the time allowed for processing decreases so does the residence time in each of the processing steps. The rates of development and fix must be rapid to insure that an image is obtained which is a faithful rendition of the input image. Incomplete development results in an image which is poorly resolved and incomplete fixing leads to a high background density and poor aging characteristics. Rapid washing requires rapid diffusion of liquid into the film binder and rapid diffusion of deleterious materials out of the film binder.

Particularly relevant to this invention is the decreased residence time in the dryer. With a decrease in dryer residence time either the amount of volatile material removed must be decreased or the rate of removal of the material must be increased. Decreasing the amount of volatile material is difficult since this has a deleterious effect on the washing. Therefore, the ideal film would exhibit relatively high absorption of solution but rapid drying abilities.

Rapid drying film is a necessity in modern photographic elements. The amount of total binder can be decreased yet this often creates physical quality problems as known in the art. A major task of the film binder is to safely harbor the silver halide grains and protect the grains from damage from surface abrasion, bending and the like. As the amount of total binder is decreased the physical damage resulting from such actions becomes noticeably worse and the films are deemed to be inferior.

Materials which are easily washed out of the film are routinely taught yet this leads to problems with processor fouling and the like. The material which washes out of the film most often contaminates the processing solutions and the materials can deposit on drive rollers in the processor or redeposit on subsequent sheets of film rendering them aesthetically displeasing.

There has been a long felt desire in the art for a binder which can absorb solution and dry rapidly without a large amount of washout material.

SUMMARY OF THE INVENTION

It is an object of the present invention to provide a rapid drying coating specifically useful in a photographic element.

It is another object of the present invention to provide a coating composition for photographic elements which can absorb an increased amount of water and liberate the water rapidly.

Yet another object of the present invention is to provide a coating composition for photographic elements which can absorb a large quantity of water and readily liberate the water without adversely affecting the sensitometric performance of the photographic element.

A particular feature of the present invention is the ability to dry rapidly during photographic processing.

Additional advantages and features will be apparent to one skilled in the art of the present invention.

Provided is a photographic element comprising:

a support;

at least one layer coated on said support wherein said layer comprises:

(a) hydrophilic colloid;

(b) 0.0001 to 0.020 grams of a branched polysaccharide per gram of said hydrophilic colloid;

(c) 0.001 to 0.3 grams of a polyacrylamide per gram of said hydrophilic colloid; and at least one of either (d) or (e):

(d) 0.05 to 0.8 grams of a mixture of by weight 1–99 % polyvinylidene chloride by weight 1–99 % polyacrylate by weight per gram of said hydrophilic colloid; or (e) 0.05 to 0.8 grams of a copolymer of vinylidene chloride and acrylate per gram of said hydrophilic colloid.

A preferred embodiment is provided in a photographic element comprising:

a support;

at least one layer comprising hydrophilic colloid coated on said support wherein said hydrophilic colloid layer comprises:

(a) 0.0001 to 0.02 grams of xanthan gum per gram of said hydrophilic colloid;

(b) 0.001 to 0.3 grams of polyacrylamide per gram of said hydrophilic colloid; and at least one chosen from the set consisting of:

(c) a mixture of polyvinylidene chloride and polyacrylate; and (d) a copolymer of vinylidene chloride and acrylate.

Yet another preferred embodiment is provided in a photographic element comprising in order:

a support;

a first layer coated on said support;

a second layer coated supra to said first layer;

wherein said first layer comprises:

(a) a hydrophilic colloid;

(b) a branched polysaccharide; and (c) a polyacrylamide;

wherein said second layer comprises:

(a) a hydrophilic colloid;

(b) a branched polysaccharide;

(c) a polyacrylamide; and at least one chosen from the set consisting of:

(d) a mixture of polyvinylidene chloride and polyacrylate; and (e) a copolymer of vinylidene chloride and acrylate.

DETAILED DESCRIPTION OF THE INVENTION

A rapid drying photographic binder is provided which contains the novel combination of:

a) a branched polysaccharide;

b) a polyacrylamide; and at least one of either c) a mixture of polyvinylidene chloride and polyacrylate; or d) a copolymer of vinylidene chloride and acrylate.

Preferred branched polysaccharides are chosen from D-mannose, D-glucose, D-glucuronic acid, D-galacto-D-mannoglycan and Xanthan gum. The most preferred branched polysaccharide is Xanthan gum. Xanthan gum is a high molecular weight polysaccharide derived from *Xanthamonas campestris*. It contains D-glucose, D-mannose, and D-glucoronic acid as the dominant hexose units. More details can be obtained in the publication: Federal Register, vol 34, No. 53, Mar. 19, 1969, subchapter B, part 121, subpart D; Keltrol, Technical Bulletin DB No. 18, Kelco Company, Clark, N.J.

Particularly preferred polyacrylamides are defined by Formula 1:

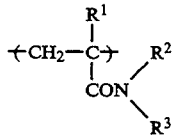

Formula 1.

Referring specifically to Formula 1. $R^1$ represents hydrogen, alkyl or substituted alkyl of 1 to 6 carbon atoms. Preferably $R^1$ represents hydrogen or methyl. $R^2$ and $R^3$ independently represent hydrogen; alkyl or substituted alkyl of 1 to 10 carbons; substituted or unsubstituted aryl of 6 to 10 carbons; a substituted or unsubstituted aralkyl of 7 to 11 carbons. $R^2$ and $R^3$ may independently represent the atoms chosen from C, N, O, and S necessary to form a substituted or unsubstituted 5- or 6-membered ring or $R^2$ and $R^3$ may be taken together along with the nitrogen atom to which they are attached to form a substituted or unsubstituted 5- or 6-membered heterocyclic ring.

In a preferred embodiment, $R^2$ and $R^3$ may independently represent the atoms chosen from C, N, O, and S necessary to form a substituted or unsubstituted 5- or 6-membered ring or $R^2$ and $R^3$ may be taken together with the nitrogen atom to which they are attached to form a 5- or 6-membered nitrogen-containing substituted or unsubstituted heterocyclic ring. Preferred examples of $R^2$ and $R^3$ being taken together include $—CH_2(CH_2)_2CH_2—$, $—CH_2(CH_2)_3CH_2—$ and $—CH_2CH_2OCH_2CH_2—$. Most preferably $R^2$ or $R^3$ are independently chosen from hydrogen; methyl; ethyl; or phenyl. Most preferably $R^2$ and $R^3$ are hydrogen.

The copolymer of polyvinylidene chloride and polyacrylate can be defined by Formula 2:

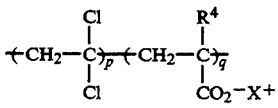

Formula 2.

Referring specifically to Formula 2. $R^4$ represents a hydrogen, alkyl or substituted alkyl of 1 to 6 carbons. The molar ratios of monomer are defined by p and q wherein p/q is preferably 1 to 20, more preferably 5 to 15, and most preferably 9 to 11. X is a counter ion preferably chosen from alkali earth metals; alkyl amines of 1 to 20 carbons; hydrogen, ammonium, and the like.

The polyvinylidene chloride is defined by Formula 2 when q is equal to 0 and the polyacrylate is defined by Formula 2 when p is equal to 0.

The terms substituted alkyl, substituted aryl, and substituted aralkyl are used as common in the art. Preferred substituents include hydroxyl, lower alkoxy of 1 to 6 carbon atoms such as methyl, ethyl, n-propyl, n-butyl, isobutyl, sec-butyl, tert-butyl, n-pentyl, and n-hexyl, preferably a methyl group or an ethyl group; halogen such as chlorine or bromine; amine; an amido group such as acetamido and propionamido; cyano; sulfo; and carboxyl.

Preferred examples of the substituted and unsubstituted alkyl group include methyl, ethyl, n-propyl, isopropyl, sec-butyl, tert-butyl, n-pentyl, n-hexyl, cyclohexyl, hydroxymethyl, 2-hydroxyethyl, ethoxymethyl, 2-ethoxyethyl, phenoxymethyl, 2-phenoxy-ethyl, benzyloxymethyl, 2-benzyloxyethyl, chloromethyl, 1-chloroethyl, 2-chloroethyl, bromomethyl, 2-bromoethyl, cyanomethyl, 2-cyanoethyl, $—C(CH_3)_2SO_3H$, and $—C(CH_3)_2SO_3Na$.

Preferred examples of the substituted or unsubstituted aryl group include phenyl; o-, m- and p-tolyl; 2,3-, 2,4- and 2-5 xylyl; mesityl; o-, m-, and p-cumenyl; 1- and 2-naphthyl; hydroxyphenyl; methoxyphenyl; ethoxyphenyl; chlorophenyl; bromophenyl; cyanophenyl; $—C_6H_4COOH$; $—C_6H_4CONH_2$; $—C_6H_3(CONH_2)_2$. Examples of the substituted or unsubstituted aralkyl group include benzyl; $—CH_2C_6H_4CH_3$ and $—CH_2CH_2C_6H_5$.

The 5- or 6-member ring, or substituted 5- or 6-member ring, may be broadly described provided the above mentioned properties are not compromised. The ring may be substituted or unsubstituted. Exemplary rings structures within the teachings of the invention are aryl, cycloalkyl, cycloalkenyl, indoles, piperidine, piperidyl, piperazinyl, pyrrolidine, pyrrolidinyl, pyrazolidine, pyrimidine, furan, thiophene, oxazine, and the like.

The branched polysaccharide, polyacrylamide and one of either (a) mixture of polyvinylidene chloride and polyacrylate, or (b) copolymer of vinylidene chloride and acrylate is typically added to an aqueous solution of hydrophilic colloid. The aqueous solution of hydrophilic colloid may include silver halide, dyes, coating additives, color couplers and other adjuvants common in the art of photographic sciences. The amount of each ingredient is chosen for coatability.

The branched polysaccharide is preferably added in an amount of from 0.0001 to 0.02 grams per gram of hydrophilic colloid in the layer. Below 0.0001 grams of branched polysaccharide per gram of hydrophilic colloid the improvements are not observed and above an amount of 0.02 grams of branched polysaccharide per gram of hydrophilic colloid the viscosity of the solution is to high to afford suitable coating quality and solubility of the branched polysaccharide is limited. More preferred is 0.001 to 0.003 grams of branched polysaccharide per gram of hydrophilic colloid in the layer.

The polyacrylamide is added in an amount of 0.001 to 0.30 grams of polyacrylamide per gram of hydrophilic colloid in the layer. Preferably the polyacrylamide is added in an amount equal to 0.03 to 0.12 grams of polyacrylamide per gram of hydrophilic colloid in solution.

The mixture of polyvinylidene chloride and polyacrylate is preferably added to equal a combined amount of 0.05 to 0.8 grams of total polymer per gram of hydrophilic colloid in the layer. Preferably the combined amount of polyvinylidene chloride and polyacrylate are added to equal a combined amount of 0.12 to 0.2 grams per gram of hydrophilic colloid in the layer. Preferably, the combination of polyvinylidene chloride and polyacrylate are in a ratio of approximately 1–99% polyvinylidene chloride by weight and approximately 1–99% polyacrylate by weight. More preferred is a combined polymer weight of 20–80% polyacrylate by weight and 20–80% polyvinylidene chloride by weight.

The copolymer of vinylidene chloride and polyacrylate is preferably added in an amount equal to 0.05 to 0.8 grams of polymer per gram of hydrophilic colloid in the coating layer. More preferably the polymer is added in an amount equal to 0.12 to 0.2 grams of polymer per gram of hydrophilic colloid.

The amounts are recited as a function of hydrophilic colloid in the layer. It is understood that a layer may be formed from a distinct coating solution and one skilled in the art would appreciate that the solution would contain the same amount of solid per gram of hydrophilic colloid as the coating solution. If interlayer mixing occurs the concentrations must be adjusted as appropriate.

The combination of branched polysaccharide, polyacrylamide and at least one of (a) mixture of polyvinylidene chloride and polyacrylate or (b) copolymer of vinylidene chloride and ethyl acrylate is particularly suitable for use in a hydrophilic colloid layer wherein rapid drying is advantageous. Particularly suitable is a photosensitive layer, or an auxiliary layer, since rapid drying is also hypothesized to be related to rapid diffusion, although the present invention is not restricted by this hypothesis. Other layers may contain some of the elements to assist in coating. A particularly preferred photographic element is obtained with a multiplicity of layers. At least one layer comprises the ingredients of the present invention, namely branched polysaccharide, polyacrylamide and at least one of (a) mixture of polyvinylidene chloride and polyacrylate or (b) copolymer of vinylidene chloride and acrylate.

The layer closest to the support, commonly referred to as the underlayer, preferably comprises hydrophilic colloid, a branched polysaccharide and a polyacrylamide. The branched polysaccharide and polyacrylamide improve the coating latitude as determined by the vacuum range as detailed in U.S. Pat. No. 5,268,263. The underlayer preferably comprises 0.0001 to 0.02 grams of branched polysaccharide per gram of hydrophilic colloid and 0.001 to 0.20 grams of polyacrylamide per gram of hydrophilic colloid. More preferred is 0.001 to 0.003 grams of branched polysaccharide and 0.03 to 0.12 grams of polyacrylamide per gram of hydrophilic colloid.

A photosensitive layer typically comprises silver halide dispersed in a hydrophilic colloid binder. The silver halide is sensitized as known in the art and the layer may contain other adjuvants such as dyes, stabilizers, development agents, color coupling agents, toners, surfactants, and the like.

An underlayer typically comprises a hydrophilic colloid layer with an optional dye dispersed therein. The overcoat is typically coated supra to the photosensitive layer as protection from abrasion and the like and may comprise dyes or other adjuvants as known in the art.

The term "hydrophilic colloid" or its homologue "gelatin" is used herein to refer to the protein substances which are derived from collagen. In the context of the present invention "hydrophilic colloid" also refers to substantially equivalent substances such as synthetic analogues of gelatin. Generally gelatin is classified as alkaline gelatin, acidic gelatin or enzymatic gelatin. Alkaline gelatin is obtained from the treatment of collagen with a base such as calcium hydroxide, for example. Acidic gelatin is that which is obtained from the treatment of collagen in acid such as, for example, hydrochloric acid and enzymatic gelatin is generated with a hydrolase treatment of collagen. The teachings of the present invention are not restricted to gelatin type or the molecular weight of the gelatin. It is preferable to harden or crosslink the hydrophilic colloid as know in the art.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British Patent 766,290 and Canadian Patent 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

The utility of the invention will now be demonstrated in the following examples. These examples are not intended to limit the invention in any way.

Photographic Emulsion

A 0.06 $\mu m^3$ cubic silver bromide grain was prepared as known in the art. The grain was washed using standard techniques. The grains were chemically sensitized with sulfur as known in the art followed by addition of 16.7 mg of sensitizing dye SD-1 per mole of silver in accordance with U.S. Pat. No. 3,682,640. The amounts of polyacrylamide, vinylidene chloride/methylmethacrylate combinations and branched polysaccharide were added as indicated in the tables. The resulting films were chemically processed after exposure with a HeNe laser in a manner consistent with medical laser imaging applications. The results are contained in Table 2. Speed is reported relative to a control which is arbitrarily assigned a speed of 100. MG is mid-gradient and DM is maximum density obtained.

SD-1

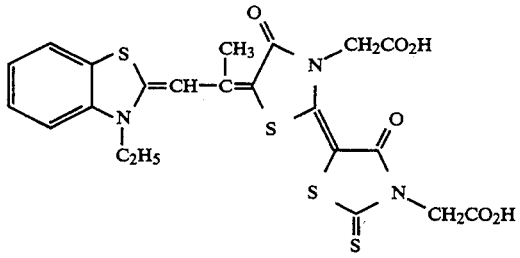

Coating Experiments

An overcoat was prepared to determine the effect of sensitometric performance and drying capabilities with the inventive coating composition. Several overcoat coating solutions were prepared with gelatin, polyacrylamide (PAA), a copolymer of approximately 10 parts vinylidene chloride and 1 part methylmethacrylate (CP), and xanthan gum (XG) in the amounts necessary to provide the coating weights listed in Table 1. For the controls the gelatin concentration was approximately 9.5% by weight and for the inventive examples the total solids were approximately 13–17% of the coating solution. The viscosities were approximately 13–16 centipoise. The overcoat solution was coated over the photographic emulsion in a conventional manner on an appropriately subcoated polyethylene terephthalate support. The sensitometric performance was measured by standard methods including a _2 step wedge. Processing was accomplished in a conventional medical X-ray processor charged with HSD developer (available from E. I. DuPont de Nemours and Co., Wilmington, Del.) and HSF fixer (available from E. I. DuPont de Nemours and Co., Wilmington, Del.) at 90 seconds and 35° C. The sensitometric performance reported in Table 2 indicates that sensitometric performance is not adversely affected versus the control and is actually improved in some parameters.

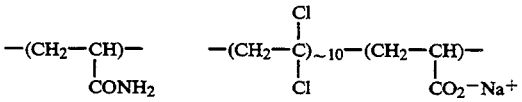

PAA CP

TABLE 1

| Sample | Gelatin mg/Dm$^2$ | PAA mg/Dm$^2$ | CP mg/Dm$^2$ | XG mg/Dm$^2$ | |
|---|---|---|---|---|---|
| C-1 | 14.0 | 0.0 | 0.0 | 0.0 | Control |
| I-1 | 10.2 | 0.7 | 0.6 | 0.05 | Inventive |
| I-2 | 9.0 | 1.0 | 1.6 | 0.05 | Inventive |
| C-2 | 12.0 | 0.0 | 0.0 | 0.0 | Control |

Control sample C-2 was observed to have inferior coating quality due to hydrodynamic chatter.

TABLE 2

| Sample | Fog | Speed | AG | Density | |
|---|---|---|---|---|---|
| C-1 | 0.09 | 101 | 2.05 | 2.78 | Control |
| I-1 | 0.08 | 103 | 2.07 | 2.68 | Inventive |
| I-2 | 0.09 | 109 | 1.95 | 2.65 | Inventive |
| C-2 | 0.09 | 100 | 1.98 | 2.7 | Control |

In Table 1, Fog is the density of unexposed, developed silver on a clear polyethylene terephthalate support. Lower fog is preferred. Speed is determined as known in the art with increasing speed beneficial. AG is average gradient as known in the art and Density is the maximum density obtained on the film with higher density being better under identical coating weights and processing conditions.

Inventive sample I-1 and Control sample C-1 were then subjected to parallel analysis of drying rate. The film was stored in a control chamber at 15% relative humidity and 21° F. for 2 hours after which the initial weight was determined. The film sample was soaked in a distilled water bath at 21° C. for 1 minute. Upon retrieval from the water bath any excess water was removed by blotting and the sample was reweighed at the time increments listed in Table 3. The drying rate was determined by fitting the water/gel ratio as a function of time (min.) to an exponential curve. The drying rate was then defined as the first derivative of the resulting equation. The ratio grams of water to grams of gelatin (W/G) and rate are provided in Table 3.

TABLE 3

| | W/G | | Rate | |
|---|---|---|---|---|
| Time | C-1 | I-1 | C-1 | I-1 |
| 0.0 | 0.49 | 0.55 | — | — |
| 0.6 | 0.44 | 0.47 | 0.08 | >0.1 |
| 1.2 | 0.39 | 0.39 | 0.07 | 0.1 |
| 1.8 | 0.36 | 0.35 | 0.06 | 0.09 |
| 2.4 | 0.33 | 0.30 | 0.05 | 0.08 |
| 3.0 | 0.30 | 0.27 | 0.05 | 0.07 |
| 3.6 | 0.28 | 0.22 | 0.04 | 0.06 |
| 4.6 | 0.25 | 0.15 | 0.04 | 0.05 |

The inventive film absorbs more solution as indicated by the higher water/gel ratio at a time of 0.0 minutes yet the rate of water removal is higher leading to a quicker drying time. The net result is a film which can absorb more water than the control and still dry quicker than the control.

What is claimed is:

1. A photographic element comprising:

a support;

at least one layer coated on said support wherein said layer comprises:

(a) hydrophilic colloid;

(b) 0.0001 to 0.020 grams of a branched polysaccharide per gram of said hydrophilic colloid;

(c) 0.001 to 0.30 grams of a polyacrylamide per gram of said hydrophilic colloid; and at least one of either (d) or (e):

(d) 0.05 to 0.8 grams of a mixture of by weight 1–99% polyvinylidene chloride and 1–99% polyacrylate per gram of said hydrophilic colloid; or (e) 0.05 to 0.8 grams of a copolymer of vinylidene chloride and acrylate per gram of said hydrophilic colloid.

2. The photographic element recited in claim 1 wherein said branched polysaccharide is chosen from the set consisting of dmannose, D-glucose, D-glucuronic acid, d-galacto-D-mannoglycan and xanthan gum.

3. The photographic element recited in claim 2 wherein said branched polysaccharide is xanthan gum.

4. The photographic element recited in claim 1 wherein said polyacrylamide is

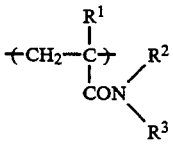

$R^1$ represents hydrogen, alkyl or substituted alkyl of 1 to 6 carbon atoms;

$R^2$ and $R^3$ independently represent hydrogen; alkyl or substituted alkyl of 1 to 10 carbons; substituted or unsubstituted aryl of 6 to 10 carbons; substituted or unsubstituted aralkyl of 7 to 11 carbons; $R^2$ and $R^3$ may independently represent the atoms chosen from C, N, O and S necessary to form a 5- or 6-membered ring or $R^2$ and $R^3$ may be taken together along with the nitrogen atom to which they are attached to form a 5- or 6-membered heterocyclic ring.

5. The photographic element recited in claim 4 wherein $R^1$ represents hydrogen or methyl.

6. The photographic element recited in claim 1 wherein said copolymer of vinylidene chloride and acrylate is

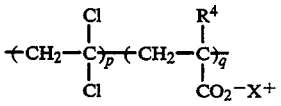

$R^4$ represents a hydrogen, alkyl or substituted alkyl of 1 to 6 carbons; p/q is 1 to 20;

X is a counter ion.

7. A photographic element comprising:

a support;

at least one layer comprising hydrophilic colloid coated on said support wherein said hydrophilic colloid layer comprises:

(a) 0.0001 to 0.02 grams of xanthan gum per gram of said hydrophilic colloid;

(b) 0.001 to 0.30 grams of polyacrylamide per gram of said hydrophilic colloid; and at least one chosen from the set consisting of:

(c) a mixture of polyvinylidene chloride and polyacrylate; and (d) a copolymer of vinylidene chloride and acrylate.

8. The photographic element of claim 7 comprising at least one chosen from the set consisting of:

(a) 0.05 to 0.8 grams of a mixture of by weight 1–99% polyvinylidene chloride and 1–99% polyacrylate per gram of said hydrophilic colloid; and (b) 0.05 to 0.8 grams of a copolymer of vinylidene chloride and acrylate per gram of said hydrophilic colloid.

9. A photographic element comprising in order:

a support;

a first layer coated on said support;

a second layer coated supra to said first layer;

wherein said first layer comprises:

(a) a hydrophilic colloid;

(b) a branched polysaccharide; and (c) a polyacrylamide;

wherein said second layer comprises:

(a) a hydrophilic colloid;

(b) a branched polysaccharide;

(c) a polyacrylamide; and at least one chosen from the set consisting of:

(d) a mixture of polyvinylidene chloride and polyacrylate; and (e) a copolymer of vinylidene chloride and acrylate.

10. The photographic element of claim 9 wherein said first layer comprises silver halide.

* * * * *